US006167959B1

(12) United States Patent
Bassinger et al.

(10) Patent No.: US 6,167,959 B1
(45) Date of Patent: Jan. 2, 2001

(54) ADJUSTABLE STUFFING BOXES FOR PUMP RODS

(75) Inventors: Grey Bassinger; Joseph L. Dalton, III, both of Odessa, TX (US)

(73) Assignee: Auto Pax Products, L.L.C., Odessa, TX (US)

( * ) Notice: Under 35 U.S.C. 154(b), the term of this patent shall be extended for 0 days.

(21) Appl. No.: 09/188,921

(22) Filed: Nov. 9, 1998

(51) Int. Cl.[7] ..... E21B 33/03
(52) U.S. Cl. ..... 166/84.2; 166/84.4; 277/329
(58) Field of Search ..... 166/84.2, 84.1, 166/84.4; 277/329, 330

(56) References Cited

U.S. PATENT DOCUMENTS

| | | | | |
|---|---|---|---|---|
| 1,911,670 | | 5/1933 | Black . | |
| 1,947,198 | | 2/1934 | Goble . | |
| 2,048,320 | * | 7/1936 | Bennett | 384/149 |
| 2,069,443 | | 2/1937 | Hill . | |
| 2,159,306 | | 5/1939 | Winters . | |
| 2,179,814 | | 11/1939 | Conaghan . | |
| 2,182,246 | | 12/1939 | Boyer et al. . | |
| 2,219,064 | | 10/1940 | Boyer et al. . | |
| 2,567,479 | * | 9/1951 | Hebard | 277/329 |
| 2,628,112 | * | 2/1953 | Hebard | 277/506 |
| 2,721,748 | | 10/1955 | Tremolada . | |
| 3,244,424 | | 4/1966 | Cope . | |
| 3,395,923 | * | 8/1968 | Remke et al. | 277/329 |
| 3,468,374 | * | 9/1969 | Reeves | 166/84 |
| 3,512,787 | | 5/1970 | Kennedy et al. . | |
| 3,675,933 | | 7/1972 | Nappe . | |
| 3,722,894 | | 3/1973 | Cameron-Johnson . | |
| 3,886,804 | | 6/1975 | Winfield, Jr. . | |
| 3,887,196 | | 6/1975 | Renfrow . | |
| 4,008,897 | | 2/1977 | Wentworth . | |
| 4,320,799 | | 3/1982 | Gilbertson . | |
| 4,345,766 | | 8/1982 | Turanyi . | |
| 4,490,097 | | 12/1984 | Gilbertson . | |
| 4,560,176 | | 12/1985 | Hoff . | |
| 4,907,650 | * | 3/1990 | Heinonen | 166/80 |
| 4,981,174 | | 1/1991 | White . | |
| 5,067,563 | * | 11/1991 | Rode | 166/84 |
| 5,137,083 | | 8/1992 | Bump . | |
| 5,343,944 | | 9/1994 | Bassinger . | |
| 5,538,080 | | 7/1996 | Bassinger . | |
| 5,636,688 | * | 6/1997 | Bassinger | 166/84.4 |
| 5,803,169 | | 9/1998 | Bassinger et al. . | |

* cited by examiner

*Primary Examiner*—Hoang Dang
(74) *Attorney, Agent, or Firm*—Akin, Gump, Strauss, Hauer & Feld, L.L.P.

(57) ABSTRACT

Stuffing boxes for use with reciprocating or rotating pump rods for downhole pumps include a lower housing adapted to be mounted on a wellhead and provided with internal bores for receiving the pump rod and a packing housing engaged with the lower housing and including a central bore for receiving a packing assembly and a packing gland. The packing gland may include an annular flange for supporting circumferentially spaced bolts engageable with cooperating bores in the packing housing to adjust compression on the packing and to provide for rotatably indexing the gland to minimize uneven wear. An axially slidable bushing mounted in the packing housing or lower housing is engageable with the opposite end of the packing assembly and is provided with a transverse annular shoulder engaged by a bias spring for exerting compression forces on the packing assembly. The bushing includes a transverse end face exposed to pressure fluid to also urge the bushing into engagement with the packing assembly. An annular cavity for the bushing bias spring may be filled with a lubricant at neutral pressure provided by equal diameter portions of the bushing. An annular packoff element may be disposed in the lower housing and engaged by the packing housing to form a temporary seal during repair or replacement of the packing assembly and/or the packing gland.

34 Claims, 7 Drawing Sheets

ADJUSTABLE STUFFING BOXES FOR PUMP RODS

FIELD OF THE INVENTION

The present invention pertains to adjustable stuffing boxes and seal assemblies for cylindrical shafts or rods, particularly well pump rods.

BACKGROUND

A longstanding problem in the well pumping industry pertains to providing a suitable seal around the reciprocating pump rod or so-called "polished" rod section of an elongated down-hole pump rod string. This problem is found to exist also in connection with downhole rotary pumps and rotary drive shaft seals therefor. In rod actuated well pump systems, the upper end of the elongated rod string which is connected to a pump actuating mechanism or so-called pump-jack is typically exposed to the ambient environment extremes and must operate for long periods of time unattended due to the remote location of many well pumps. However, the seal assembly that surrounds the polished rod section of the pump rod string, sometimes commonly referred to as a stuffing box, is a critical element to prevent unwanted discharge of well fluids from the wellhead at the point of entry of the rod string.

Several efforts have been undertaken to develop improvements in pump rod stuffing boxes. U.S. Pat. Nos. 5,343,944; 5,538,080 and 5,636,688 and copending U.S. patent application Ser. No. 09/024,738 filed Feb. 17, 1998, now U.S. Pat. No. 6,000,469 all to Grey Bassinger and U.S. Pat. No. 5,803,169 issued Sep. 8, 1998 to Grey Bassinger and Joseph L. Dalton, all assigned to the assignee of the present invention, represent improvements in stuffing boxes for well pump rods. However, certain applications for stuffing boxes for well pumps do not require the self-aligning features of the above-mentioned patents and patent application, may have a shorter service life by design, or, for various reasons, do not require the features of the inventions of the above-referenced patents and patent application. Moreover, virtually all applications for well pump stuffing boxes require simplicity of stuffing box design, reliability in operation, unattended operation for long periods of time, and ease of adjustment and/or replacement or repair of the stuffing box components when an attendant is present to service the stuffing box. Accordingly, features which are desirable in pump rod stuffing boxes include automatic adjustment of the packing to compensate for wear thereof, a suitable cavity for lubricant to lubricate certain movable parts in the stuffing box, providing for pressure forces acting to compress the packing which correspond to or are proportional to fluid pressure forces against which the packing is providing a seal, ease of adjustment of the forces acting on the packing as provided by a packing gland, indexible parts which are subject to wear from lateral deflection of the pump rod, ease of repair and adjustment and a temporary seal or pack-off feature to prevent well fluids from flowing, under pressure, into the stuffing box during partial disassembly and repair or packing replacement.

The present invention provides the desiderata mentioned above as well as solving other problems in the art of adjustable stuffing boxes for reciprocating pump rods and the like.

SUMMARY OF THE INVENTION

The present invention provides an improved adjustable stuffing box, particularly adapted for providing a seal for a pump shaft or rod for downhole well pumps and the like.

In accordance with one important aspect of the present invention, a stuffing box for a reciprocating pump rod is provided which includes a packing gland which may be adjusted at will and may be rotatably indexed to compensate for wear generated by lateral deflection of the pump rod.

In accordance with another important aspect of the invention, a slidable bushing is disposed in the stuffing box and acts against the packing under the urging of spring forces as well as fluid pressure forces to compensate for wear on the packing, to increase forces acting on the packing proportional to fluid pressure forces acting on the stuffing box and to extend the interval or operating time before adjustment of the packing gland is required.

In accordance with still another aspect of the invention, a stuffing box is provided which includes a housing supporting a slidable bushing acting on the stuffing box packing under the urging of spring forces and fluid pressure forces and which is disposed partially in a neutral pressure cavity which may contain a lubricant to lubricate the bushing and seals therefor. The stuffing box packing is also disposed between the spring and fluid pressure force biased packing adjustment bushing and a packing gland and also functions as a bushing or bearing to minimize wear on the gland and adjustment bushing due to any lateral deflection of the rod.

In accordance with yet another aspect of the present invention, an adjustable stuffing box for a well pump rod and the like is provided wherein during adjustment, repair or replacement of stuffing box parts, a so-called pack-off or temporary seal element may be activated to prevent pressure fluid from entering the stuffing box from the wellbore or associated wellhead structure.

The present invention also provides a stuffing box and seal assembly adapted for use with a rotary pump shaft or rod for driving a downhole well pump and the like and which enjoys the benefits and advantages of the invention described hereinabove. Still further, the improved rotary shaft stuffing box of the invention is advantageously provided with a packing coolant flow circuit.

The present invention provides adjustable stuffing boxes for pump rods and the like which meet the desiderata mentioned hereinabove and solve problems associated with pump rod or shaft seal stuffing boxes in a manner heretofore unappreciated in the art. Those skilled in the art will recognize the above-mentioned superior features and advantages of the present invention together with other important aspects thereof upon reading the detailed description which follows in conjunction with the drawing.

DETAILED DESCRIPTION OF PREFERRED EMBODIMENTS

Figure 1:
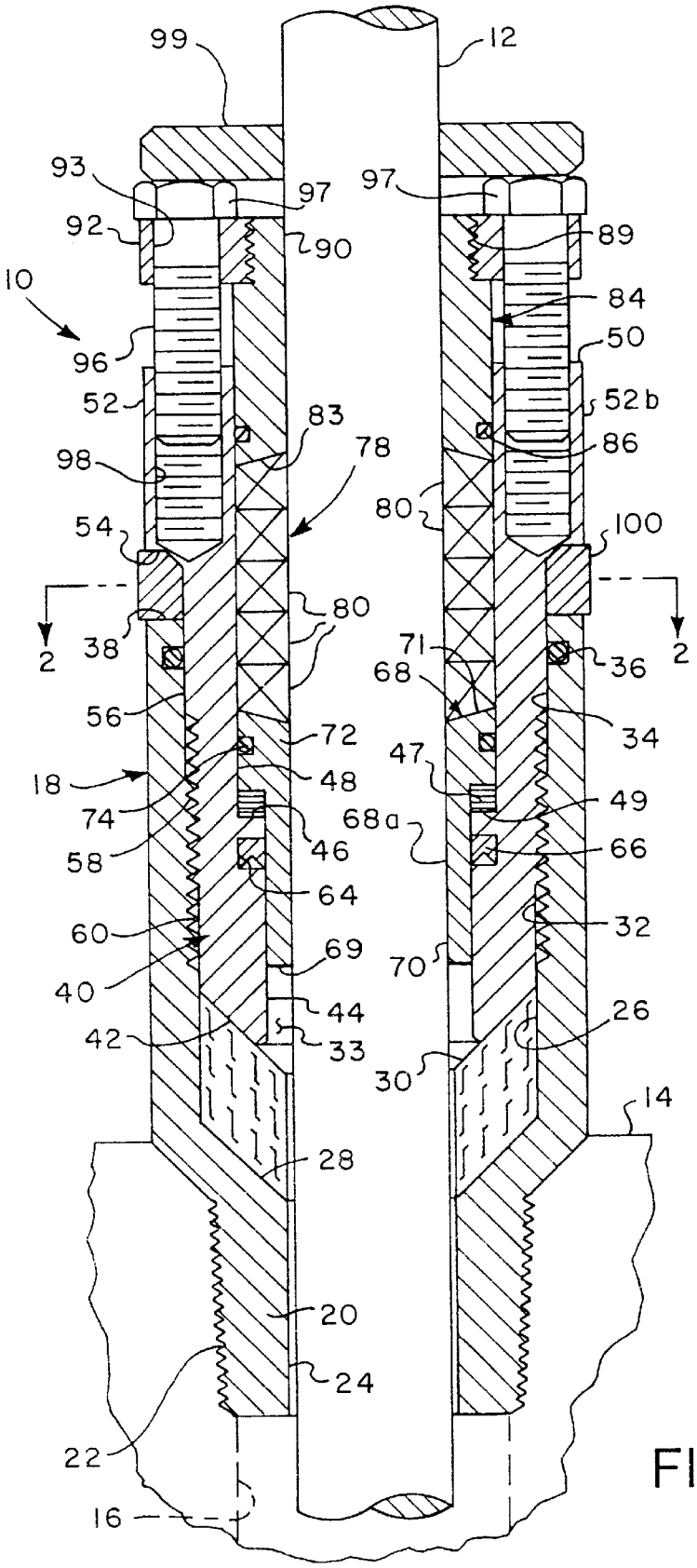
FIG. 1 is a longitudinal central section view of one preferred embodiment of an adjustable stuffing box in accordance with the invention.

In the description which follows like parts are marked throughout the specification and drawing with the same reference numerals, respectively. The drawing figures are not necessarily to scale and certain features may be shown exaggerated in scale or in somewhat generalized form in the interest of clarity and conciseness.

Referring to FIG. 1, there is illustrated a longitudinal central section view of an adjustable stuffing box and seal assembly for a reciprocating pump rod, generally designated by the numeral 10. The stuffing box 10 is adapted to seal a reciprocating cylindrical pump rod section 12 against release of pressure fluid from a well structure including a wellhead member 14 having a passage 16 therein in which pressure fluids are present. The operating environment of a stuffing box for a reciprocating pump rod, including the so-called polished rod section 12, is believed to be well known to those skilled in the art of reciprocating well pumps and further description or illustration of the pumping system including the actuating mechanism to which the upper end of the polished rod 12 is connected is not believed to be necessary to practice the present invention.

The stuffing box 10 includes a lower housing or coupler 18 comprising an elongated cylindrical tubular member having a reduced diameter section 20 which is externally threaded at 22 to be threadedly coupled to the wellhead member 14. The lower housing 18 includes a central bore 24 slightly larger than the diameter of the pump rod 12 and which opens into a second and larger bore 26, the bores 24 and 26 being interconnected by a frustoconical wall portion 28 which is adapted to support a flexible and compressible annular pack-off element 30 which, in a relaxed condition, remains out of contact with the rod 12. The bore 26 includes an internally threaded portion 32 extending upwardly to a slightly enlarged clearance bore portion 34 which is intersected by an annular o-ring seal 36 disposed in a suitable annular groove in the housing 18. The upper end of the lower housing 18 terminates in a transverse annular end wall 38.

Referring further to FIG. 1, the stuffing box 10 includes an upper packing housing 40, which comprises a generally cylindrical member having a frustoconical shaped lower transverse endwall 42 engageable with the packoff element 30, as shown. The endwall 42 is delimited by a central axial bore 44 which extends upward to intersection with a transverse shoulder 46 which extends radially outwardly and is delimited by an enlarged diameter packing bore 48 which extends axially upwardly, viewing FIG. 1, to a transverse annular top wall 50 of the packing housing. The transverse top wall 50 is formed on a cylindrical flange 52 of the housing 40 which is also delimited by a transverse shoulder 54 substantially parallel to and spaced from the wall 50. A cylindrical sidewall 56 extends axially to an externally threaded portion 58 of the packing housing 40, which threaded portion extends downwardly to a cylindrical outer wall 60 of smaller diameter than the wall 56 and threaded portion 58 and which intersects the frustoconical bottom wall 42. An annular groove 64 opens to bore 44 and supports a conventional lip seal 66 therein which is adapted to seal a cavity 47 formed in part between the bores 44 and 48. Lip seal 66 is oriented to allow fluid in the cavity 47 to escape from the cavity under extreme pressure downwardly along the bore 44. The cavity 47 is adapted to house suitable spring means comprising a cylindrical wave spring 49 therein. Cavity 47 also may also be at least partially charged with a suitable lubricant.

The cavity 47 is closed by a generally cylindrical tubular packing adjustment bushing 68 including a depending tubular shank portion 70 axially slidable in the bore 44 and an upper annular shoulder portion 72 which includes a circumferential groove for an o-ring seal 74 engageable with the bore 48 to provide a seal between the cavity 47 and a rod packing assembly 78. Bushing 68 has a central axial bore **68*a* formed therein and dimensioned to receive rod 12** in sliding relationship to the bushing.

The packing assembly 78 includes plural axially stacked split packing ring members 80 which may be formed of conventional rod packing materials known to those skilled in the art. A long wearing, commercially available woven packing material may be used for the packing members 80. The packing assembly 78 is retained in the bore 48 between tapered or sloped end faces 71 and 83 of the respective axially slidable bushing 68 and a cylindrical packing gland 84 extending upwardly out of the packing housing 40.

The packing gland 84 is a snug axial and rotatable sliding fit in the bore 48 and is provided with a suitable annular groove for retaining an o-ring 86 therein and engageable with the bore 48 to provide a suitable seal above the packing assembly 78 to prevent unwanted substances from flowing either direction between the packing assembly and the environment external to the stuffing box 10. The packing gland 84 is provided with an upper reduced diameter externally threaded portion 89 and a central bore 90 which is a relatively close, but slidable fit relative to the pump rod 12. A generally cylindrical flange member 92 is threadedly connected to the packing gland 84, as shown, and is engageable with circumferentially spaced hex-head machine bolts 96, two shown, which are threadedly engaged with cooperating threaded bores 98 in the upper housing 40. Four equally spaced bolts 96 are preferably provided and project through cooperating bores 93, two shown, in the flange 92. When the stuffing box 10 is assembled to seal a reciprocating pump rod a cylindrical, so-called stacker ring 99 is provided to rest on the heads 97 of the bolts 96, as shown in FIG. 1.

Figure 2:
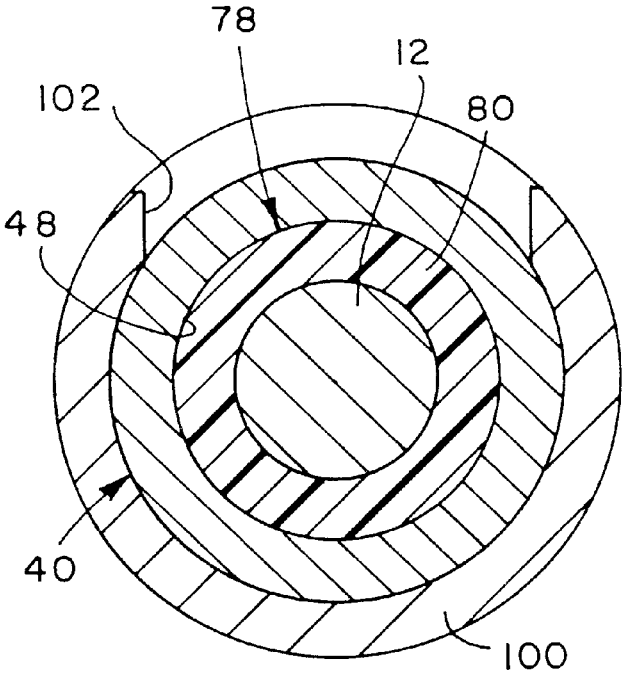
FIG. 2 is a section view taken from the line 2—2 of FIG. 1.

Referring also to FIG. 2, the arrangement of the stuffing box 10 is such that the upper packing housing 40 is adjustably engageable with the lower housing 18 at the cooperating threads 32 and 58. A limit position of the housing 40 relative to the housing 18 is provided by a removable slotted spacer or gage ring 100, preferably formed of a polymer material such as nylon, and having a radial slot 102 formed therein, FIG. 2, to allow the ring to be deflected and slipped on and off the housing 40 to be disposed between the transverse top wall 38 of housing 18 and the shoulder 54 on housing 40. Typically, the ring 100 may be removed, when desired, and the housing 40 rotated relative to the housing 18 to advance the bottom wall 42 against the packing element 30 to deflect same into forcible engagement with the rod 12. This action will provide a temporary seal or "packoff" of the bore 24 to prevent pressure fluids from flowing through the bore between the housing 18 and the rod 12 upwardly when the stuffing box has been partially disassembled, such as when replacing the packing assembly 78 or any of the elements supported in the housing 40.

The operation of the stuffing box 10 offers several advantages in the art of reciprocating pump rod stuffing boxes. The bushing 68, being axially slidable in the bore 44, reacts to spring forces exerted by the wave spring 49 to urge compression on the packing assembly 78 as the packing wears. Moreover, fluid pressure forces due to pressure fluid in cavity 33 below the bushing 68 acting on the transverse endwall 69 of the bushing, also urge the bushing 68 upwardly, viewing FIG. 1, to compress the packing assembly 78. As fluid pressure in the passage 16, the bore 24 and cavity 33 act on the bushing 68 with increased force, the packing 78 itself is further compressed by bushing 68 to resist any leakage of fluid past the packing assembly to the exterior of the stuffing box. In this way, the stuffing box 10 is also self-adjusting as a result of changes in pressure forces acting on the stuffing box, that is, more pressure forces due to fluid pressure result in more sealing or "squeeze" action on the packing assembly 78 and vice versa.

At the same time, the spring 49 urges the bushing 68 into engagement with the packing assembly 78 to maintain the packing compressed as it wears. Of course, the packing gland 84 may be adjusted, at will, by tightening or loosening the bolts 96 to effect axial movement of the packing gland relative to the housing 40.

The cavity 47 may be filled at least partially with a lubricant to provide lubrication for the bushing 68 for movement relative to the housing 40 and for the seals 66 and 74. If for any reason the volume of the cavity 47 should be reduced to squeeze lubricant out of the cavity, the seal 66 will deflect to allow such fluid to escape and prevent damage to the stuffing box elements.

Moreover, the gland 84 may be adjusted by removing the bolts 96 and rotatably indexing the gland and the flange 92 in ninety degree intervals to compensate for any wear of the gland bore 90 due to any tendency for the rod 12 to deflect laterally. Still further, the packing assembly 78 acts as a centralizing bushing itself to minimize wear on the bushing 68 and the packing gland 84. Failure of the o-rings 36, 74 and 86 will also not cause a failure of the basic function of the stuffing box 10 in that the packoff element 30 will prevent fluid escaping between housings 18 and 40 and the packing assembly 78 will provide a seal between passage 16 and the exterior of the stuffing box 10 to prevent flow of pressure fluid between the packing and the bore 48 or between the packing and the rod 12.

Repair and replacement of the stuffing box components, including the gland 84, the packing assembly 78, the bushing 68 and the seal 66 may be accomplished without removing the housing 40 from the housing 18 and, as mentioned above, removal of the ring 100 permits rotation of the housing 40 to squeeze the packoff element 30 into engagement with the rod 12 to provide a temporary seal while stuffing box component repair or replacement is carried out. The thickness of the ring 100 is predetermined to be sufficient such that, once the ring is removed from its working position, there is sufficient thread engagement remaining to be used between the housing 40 and the housing 18 whereby the housing 40 may be rotated to squeeze the packoff element 30 to provide a protective seal as described. The housing 40 is preferably provided with suitable spanner wrench receiving bores, not shown, circumferentially spaced apart at 90° intervals, for example, and intersecting the sidewall 52*b* of flange 52, such that a spanner wrench, or the like, not shown, may be used to rotate the housing 40 with respect to the housing 18 to deflect the packoff element 30. Once replacement or repair has been accomplished, the housing 40 is rotated in the opposite direction to allow the packoff element 30 to relax out of forcible engagement with the rod 12.

Accordingly, when preparing to repack the stuffing box 10, the aforementioned spanner wrench is connected to the housing 40 and rotated briefly to release compression on the ring 100 whereupon the ring is removed and the housing 40 is then rotated in the opposite direction (clockwise viewing FIG. 2 for right hand threads) to deform the packoff element 30 and seal off the housing 18 against pressure fluid in the wellhead structure 14. The bolts 96 may then be removed and the packing gland 84 moved upward along the rod 12 and held out of the way while packing elements 80 are replaced, as needed. The lift or adjustment bushing 68 may also be removed from the bore 48, if needed, for repair or replacement of the bushing and/or the spring 49. The seals 66 and 74 may also be replaced if needed. After a new bushing 68 and/or packing 78 is installed the bolts 96 are suitably tightened to at least lightly compress the packing and the spanner wrench, previously mentioned, is engaged with the housing 40 to rotate the housing in a counterclockwise direction, viewing FIG. 2, to allow the packoff element 30 to relax out of engagement with the shaft 12. The ring 100 is then reinstalled and the housing 40 is again rotated with the spanner wrench sufficiently to slightly compress the ring and force the packoff element 30 to effect a seal between the bottom wall 42 and the packoff element 30 and between the face or wall portion 28 and the packoff element. The dimensional relationships of the housings 18 and 40, the ring 100 and the packoff element 30 provide for such action.

Figure 4:
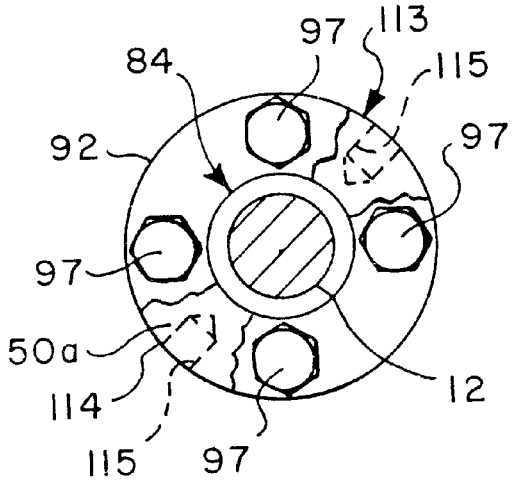
FIG. 4 is a top plan view taken from line 4—4 of FIG. 3.
Figure 3:
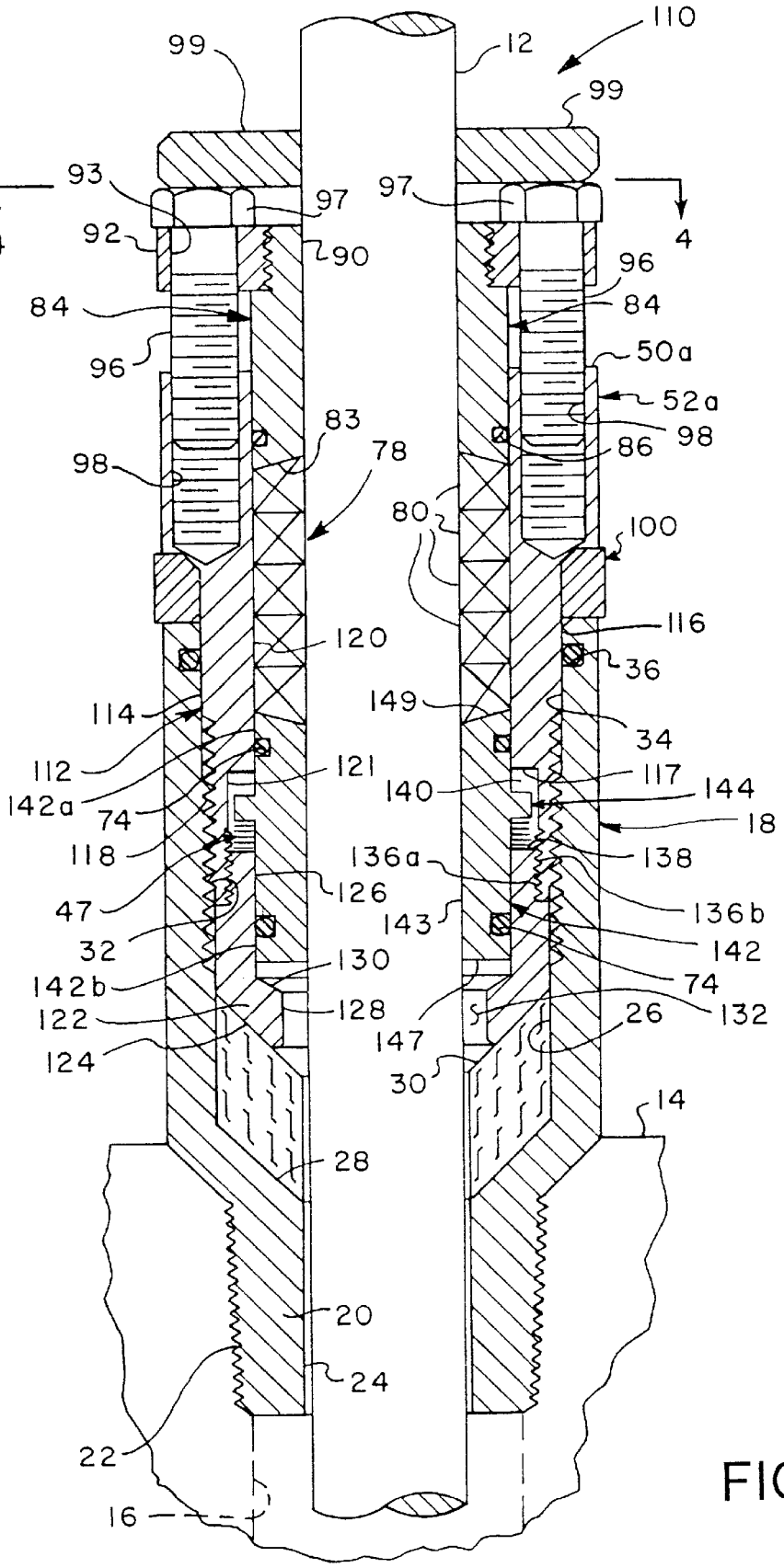
FIG. 3 is a longitudinal central section view of a first alternate embodiment of an adjustable stuffing box in accordance with the invention.

Referring now to FIGS. 3 and 4, a first alternate embodiment of a stuffing box in accordance with the invention is illustrated and generally designated by the numeral 110. The stuffing box 110 utilizes the housing 18, the packoff element 30, the ring 100, the packing gland 84, and the packing assembly 78, including the individual packing members 80. The stuffing box 84 also includes the separable flange 92 which is adapted to engage the heads 97 of the array of four machine bolts 96, see FIG. 4 also. However, the stuffing box 110 is provided with a two part upper packing housing, generally designated by the numeral 112, which is constructed similar to the housing 40 and includes an upper enlarged diameter flange part 52*a* which is integrally formed with a cylindrical depending part 114 having a tubular upper portion 116 adapted to be a snug sliding fit in the bore 34 and provided with external threads 118 for threaded engagement with the threads 32 of the housing 18, as indicated. The upper housing part 114 also includes a central bore 120 formed therein for receiving the packing assembly 78 and the packing gland 84 in the same manner as the arrangement for the stuffing box 10.

However, as indicated in FIG. 3, the packing housing 112 includes a separable, cylindrical, lower end part 122 which is provided with a frustoconical lower nose or endwall 124 engageable with the packoff element 30. Housing end part 122 includes a bore 126, a reduced diameter bore 128 and an annular shoulder 130 formed therebetween. A cavity 132 similar to the cavity 33 is formed in part by the bores 126 and 128. The packing housing part 114 is separable from the lower part 122 at cooperating threads 136*a*, 136*b*, as indicated. The housing part 114 also includes a stepped bore 121 which forms a cavity between a transverse end face 138 of the housing part 122 and a shoulder 117, FIG. 3. A cavity 140 is defined between the shoulder 117 and the transverse face 138.

A modified, generally cylindrical tubular packing or adjustment bushing 142 is slidably disposed in the bores 120 and 126, which bores are preferably of equal diameter. Bushing 142 includes a central axial bore 143 dimensioned to receive rod 12 slidably therethrough. The bushing 142 also includes an annular flange 144 formed thereon which is engageable with a wave spring 47 disposed between the flange and the transverse face 138. The flange 144 is also operable to be engaged with the shoulder 117 to provide an upward limit of travel of the bushing 142 in the packing cavity formed by the bore 120. Accordingly, opposed bushing portions 142*a* and 142*b* on opposite sides of the flange 144 are preferably of equal diameter and are provided with suitable annular grooves formed therein for receiving o-ring seals 74 adapted to be in sealing engagement with the walls defining the bores 120 and 126. The bushing 142 includes opposed end faces 147 and 149 which are also of substantially equal area.

The stuffing box 110 enjoys all of the advantages of the stuffing box 10. The bushing 142 reacts to the forces exerted by the wave spring 47 to urge the bushing into forcible engagement with the packing assembly 78, and the bushing 142 also reacts to pressure fluid forces in the cavity 132 acting on the face 147 to also exert proportional compression forces on the packing assembly. A suitable lubricant may be placed in the cavity 140. Pressure is not exerted on the lubricant due to movement of the bushing 142 in the cavity 140 when the packing is compressed or begins to wear since the bushing portions 142*a* and 142*b* are the same diameter, and the seals or o-rings 74 and the bores 120 and 126 are the same diameter. In this way, a neutral pressure in the cavity 140 allows the cavity to retain the aforementioned lubricant fluid for the seals or o-rings 74 and maintains the cavity and the seal bores 120 and 126 free of incursion of corrosive fluids.

After sufficient wear of the packing 78 occurs, the flange 144 will engage the shoulder 117 and no further upward travel of the bushing 142 will occur. If the packing assembly 78 continues to wear, fluid leakage at the top of the packing gland 84 will indicate that the packing gland needs to be adjusted by tightening the bolts 96 which will effect resetting the bushing 142 back to a position generally as indicated in FIG. 3. If the o-ring seals 74 should fail, the stuffing box 110 will still be functional in a satisfactory manner. Thanks to the arrangement of the bushing 142 and the packing gland 84, these parts, in addition to the packing assembly 78, act as bearings to react any lateral deflection forces acting on the rod 12. If lateral wear should occur on the gland 84 the bolts 96 may be removed and the gland and its flange 92 rotatably indexed at 90° intervals from time to time to allow wear to occur evenly.

As shown in FIG. 4, wherein portions of the flange 92 are broken away, the housing part 114 is provided with at least two opposed radially projecting spanner wrench receiving bores 115, preferably spaced apart as indicated, whereby the housing 112 may be engaged by a suitable wrench, not shown, and rotated to effect engagement of the packoff element 30 in the same manner as the housing 40 when it is desired to service the stuffing box 110, to replace the gland 84 or the packing assembly 78. Moreover, the stuffing box 110 may also be easily rebuilt by replacing the bushing 142, the packing assembly 78 and the packing gland 84 without replacing the housing 18 or the housing 112.

Figure 5:
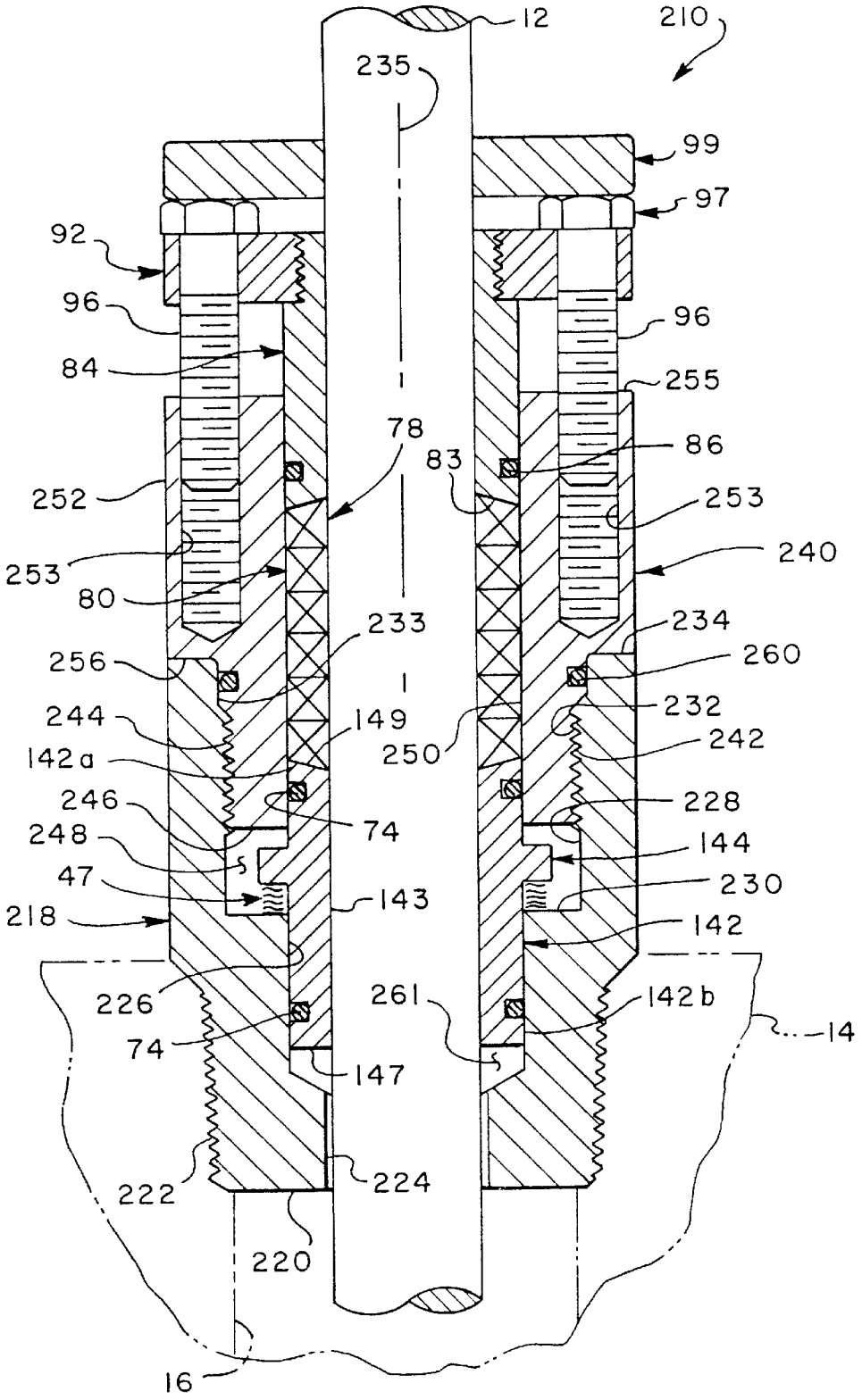
FIG. 5 is a longitudinal central section view of a second alternate embodiment of an adjustable stuffing box in accordance with the invention.

Referring now to FIG. 5, there is illustrated a second alternate embodiment of a stuffing box in accordance with the invention and generally designated by the numeral 210. The stuffing box 210 is characterized by a modified lower housing 218 including a reduced diameter externally threaded portion 220 having external threads 222 formed thereon for engagement with the wellhead structure 14. A first axial bore 224 is formed in the reduced diameter portion 220 and is slightly larger than the diameter of the rod 12. A second larger bore 226, coaxial with the bore 224, is formed in the housing 218 for receiving in slidable engagement therewith a lift or adjustment bushing 142, including the cylindrical portion 142*b*. A still larger bore 228 is also formed in the housing 218 coaxial with the bore 226 and a transverse shoulder 230 is formed between the bores 226 and 228. An internally threaded portion 232 extends from the bore 228 upwardly to a yet larger bore 233 which intersects a transverse top wall 234 of the housing 218, which top wall is substantially normal to the central axis 235 of the bores 224, 226 and 228.

The stuffing box 210 includes a single member packing housing 240 including a generally cylindrical lower part 242 which is provided with external threads 244 engageable with the threads 232 and a transverse end face 246 facing the shoulder 230 and defining a cavity 248 for receiving the circumferential flange 144 of the bushing 142, as well as a bushing bias spring 47, as illustrated. The packing housing 240 includes a central longitudinal bore 250 for receiving the packing assembly 78, the upper section 142*a* of the bushing 142 in snug fitting but slidable engagement therewith and the packing gland 84, also in snug fitting but slidable engagement with the bore 250. The upper portion of the packing housing 240 includes an enlarged diameter cylindrical flange 252 including circumferentially spaced bores 253 for receiving bolts 96 and intersecting a transverse top wall 255. A transverse shoulder 256 is formed between the upper housing part 252 and the reduced diameter lower part 242. An annular groove is formed in the reduced diameter part 242 between the threads 244 and the shoulder 256 for receiving an o-ring seal 260 engageable with bore wall of bore 233.

Accordingly, the stuffing box 210 is operable to provide a fluid tight seal between the passage 16 and the exterior of the box substantially in the same manner as the stuffing boxes 10 and 110. However, the stuffing box 210 is not provided with a packoff element between the end face 147 of the bushing and the bore 224. The bushing 142 is urged to compress the packing assembly 78 in the same manner as the other embodiments of the stuffing box as a consequence of pressure fluid entering a cavity 261 formed by the housing 218 and the bushing transverse end face 147 so that the spring 47 and fluid pressure forces acting on the end face 147 will urge the bushing 142 into forcible engagement with the packing assembly 78.

The stuffing box 210 may be adjusted to compress the packing assembly 78 in the same manner as the other embodiments of the stuffing box described herein. The cavity 248 may also be filled with a suitable lubricant to lubricate the o-ring sears 74 and to allow the bushing 142 to move freely within the bores 226 and 250 to maintain a suitable compression set on the packing assembly 78. Once the flange 144 engages the transverse face 246, the packing must be adjusted by adjustment of the gland 84. Still further, the bushing 142, the packing assembly 78 and the packing gland 84 react lateral deflection forces, if any, acting on the rod 12.

Figure 6:
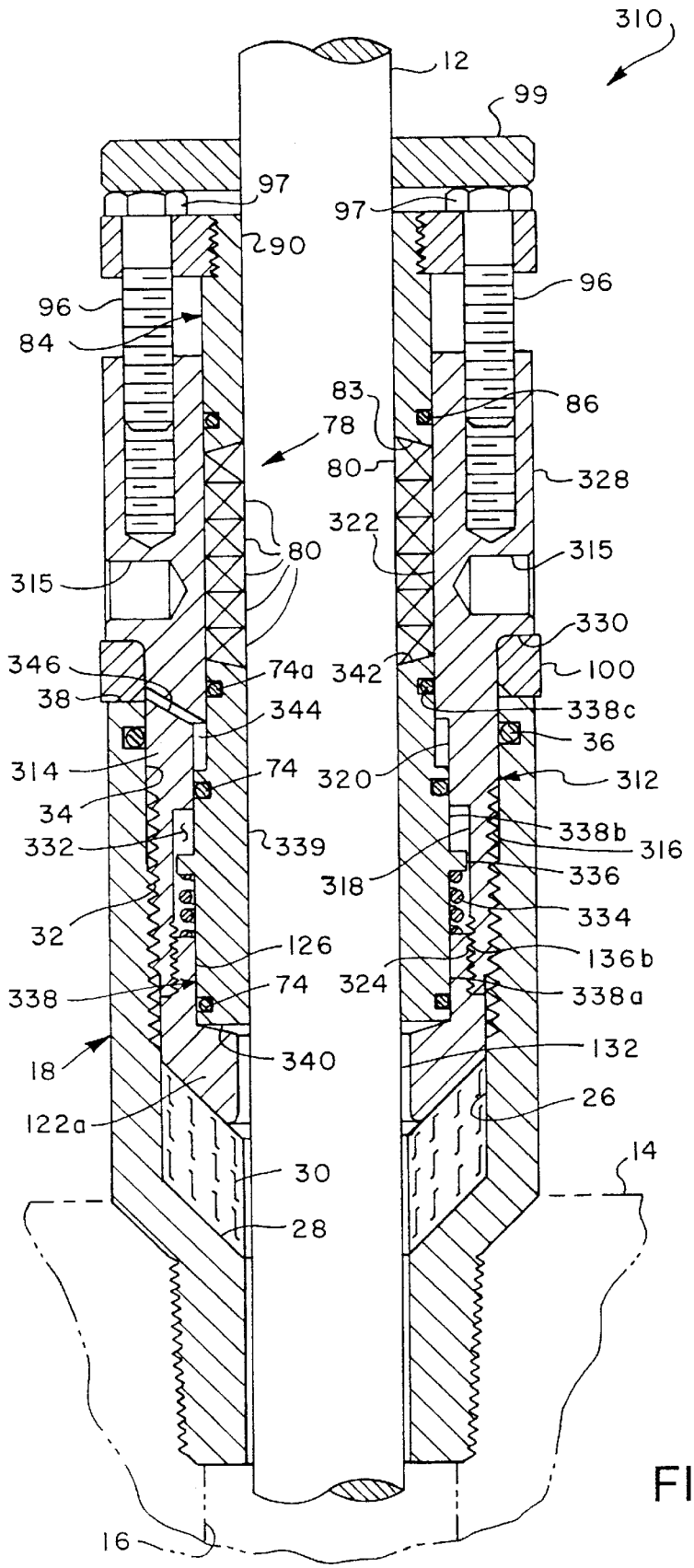
FIG. 6 is a longitudinal central section view of a third alternate embodiment of an adjustable stuffing box in accordance with the invention.

Referring now to FIG. 6, another embodiment of a stuffing box and seal assembly in accordance with the invention is illustrated and generally designated by the numeral 310. The stuffing box 310 includes a number of elements of the stuffing box 110 illustrated in FIGS. 3 and 4 and is provided with a modified packing housing 312 including a cylindrical reduced diameter portion 314 adapted to be disposed in housing bore 34 and including external threads 316 engageable with the threads 32. The packing housing 312 includes a multistepped internal cylindrical bore including a first bore portion 318, a second reduced diameter bore portion 320 and a packing receiving bore 322 for receiving packing assembly 78 and gland 84 in the same manner as the stuffing box 110.

The lower distal end of packing housing 312 includes internal threads 324 engageable with the threads 136 on a housing end part 122*a*, essentially the same as the housing end part 122 for the packing housing 112. Packing housing 312 also includes an upper elongated cylindrical flange part 328 forming a transverse annular shoulder 330 with the reduced diameter part 314 for engagement with the spacer ring 100 interposed the flange part 328 and the transverse end face 38 of the housing 18. Bore 320 is preferably the same diameter as the bore 126 of housing end part 122*a* and bore 318 forms a cavity 332 in which a coil spring 334 is disposed.

Spring 334 is engaged with a circumferential flange 336 formed on a slidable bushing 338 having a lower transverse end face 340, a first cylindrical portion 338*a*, a second cylindrical portion 338*b* of the same diameter as the portion 338*a* and a third reduced diameter portion 338*c* slidably disposed in bore 322. Suitable o-ring seals 74 are disposed on bushing portions 338*a* and 338*b* and are in sealing engagement with the bores 126 and 320, respectively. An o-ring seal 74*a* is disposed in a suitable annular groove on the reduced diameter part 338*c* and is in sealing engagement with bore 322. An upwardly facing tapered end face 342 of bushing 338 is engageable with the packing assembly 78 in substantially the same manner that the bushing 112 of the stuffing box 110 is engageable with the packing assembly of that box. An annular vented cavity 344 is formed between the bushing 338 and the packing housing 312 and is in communication with a passage 346 opening to the exterior of the stuffing box 310 to prevent pressure fluid from being trapped in the cavity and interfering with movement of the bushing 338 upwardly to bias and compress the packing assembly 78. The bushing 338 is provided with an internal bore 339 slightly greater than the diameter of the rod 12 to provide free sliding movement of the bushing relative to the rod as with the bushings of the other stuffing box embodiments described herein.

The stuffing box 310 operates in substantially the same manner as the stuffing box 110. Thanks to the provision of coil spring 334, the effective working stroke of the bushing 338 may be increased, as desired, to minimize the intervals at which adjustment of the packing gland 84 is required. Moreover, a pressure force multiplier effect may be provided by providing the bushing 338 to have a larger transverse end face 340 having a greater area than the end face 342 whereby for a given fluid pressure in the cavity 132 acting on the end face 340 a substantial compressive force may be exerted on the packing assembly 78.

The packing housing 312 is provided with at least two opposed spanner wrench receiving bores 315 formed therein for receiving a suitable spanner wrench to effect rotation of the packing housing relative to the lower housing 18 to compress the packoff element 30, when desired.

Figure 7:
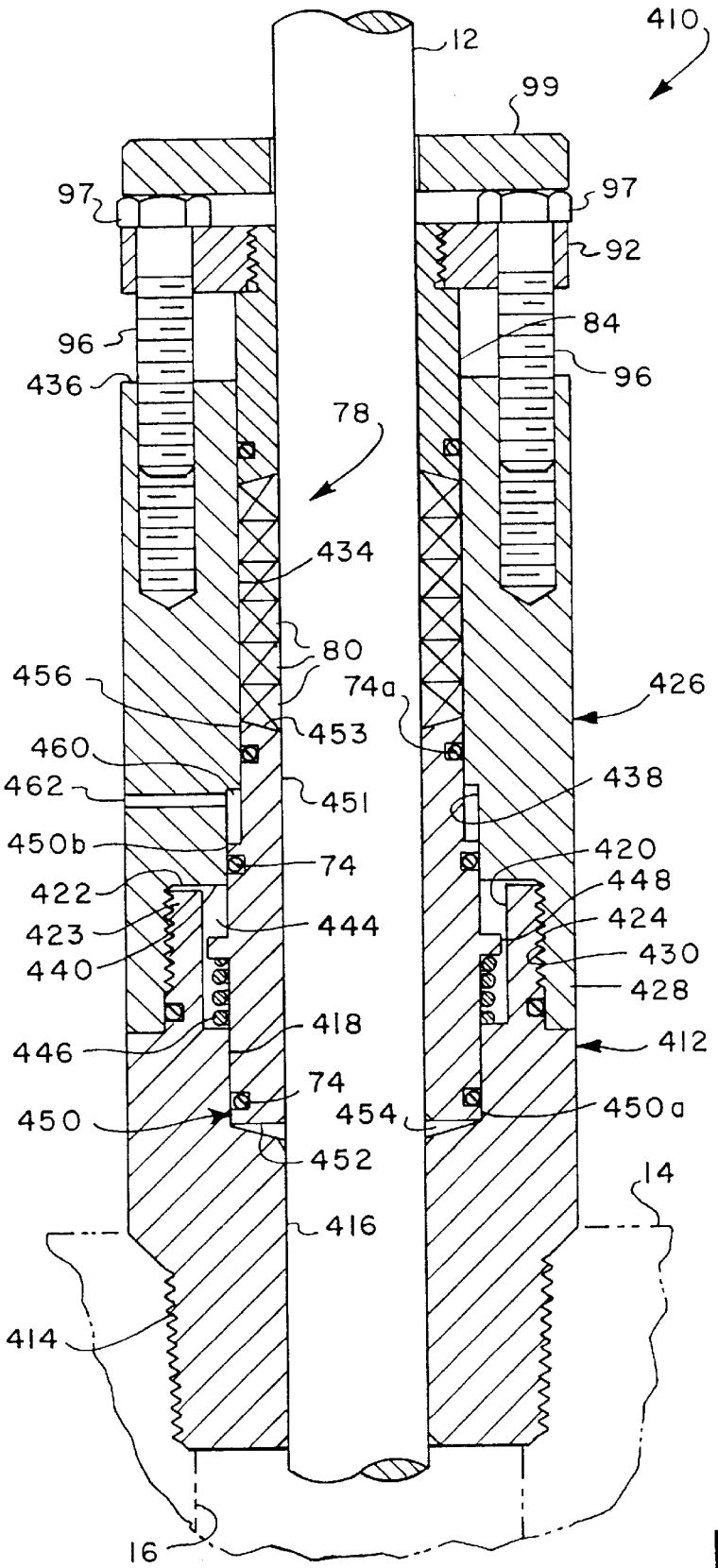
FIG. 7 is a longitudinal central section view of a fourth alternate embodiment of an adjustable stuffing box in accordance with the invention.

Referring now to FIG. 7, an embodiment of a stuffing box and seal assembly for a reciprocating pump rod 12 is illustrated and generally designated by the numeral 410. The stuffing box assembly 410 is similar in some respects to the stuffing box 210, and is provided with a lower generally cylindrical housing 412 including an externally threaded portion 414 adapted to be mounted on the wellhead member 14 in the same manner as the corresponding part for the stuffing box 210. Lower housing 412 includes a multiple stepped bore including a first bore portion 416 slightly larger than the diameter of pump rod 12, and enlarged bore 418 and yet a further enlarged bore 420 intersecting an upper transverse end face 422 of the lower housing. Lower housing 412 includes a reduced diameter part 423 having external threads 424 formed thereon for threaded engagement with a generally cylindrical packing housing 426. Packing housing 426 includes an internally threaded lower end part 428 with internal threads 430 engageable with the threads 424 for releasably connecting the housings 412 and 426 to each other.

Packing housing 426 also includes a cylindrical packing receiving bore 434 extending from an upper transverse face 436 to an enlarged bore portion 438 which intersects a transverse face 440 delimited by the thread bore for the lower housing portion 428. The housings 412 and 426 form an annular cavity 444 in which a coil spring 446 is disposed and is engageable with a circumferential flange 448 of a slidable bushing 450 substantially like the bushing 338 of the stuffing box 310.

Bushing 450 includes a lower transverse end face 452 delimiting a cavity 454 formed between the bushing 450 and the lower housing 412. Opposed cylindrical bushing portions 450*a* and 450*b* extend on opposite sides of the flange 448, are of equal diameter and are adapted to support o-ring seals 74, as shown. Bushing 450 includes an internal bore 451 slightly larger than the diameter of rod 12 and a reduced diameter upper portion 456 slidably disposed in bore 434 of the packing housing 426 and in sealing engagement therewith by an o-ring seal 74*a*. An annular cavity 460, formed by the bushing 450 and the packing housing 426, is vented to the exterior of the stuffing box 410 through a passage 462.

The stuffing box 410 includes the advantages and features of the stuffing box 310 in that the bushing 450 has a larger face area of end face 452 than of end face 453 engageable with the packing 78 so that a multiplier effect is provided by pressure fluid in cavity 454 acting on the bushing 452 to urge it upwardly to compress the packing assembly 78. The lubricant fluid in cavity 444 is maintained at a "neutral" pressure thanks to the diameters of the bushing portions 450*a* and 450*b* being equal as well as, of course, the diameters of the bores 418 and 438. A longer effective "working" stroke of the bushing 450 may be provided by the coil spring 446 acting on flange 448 to compress packing assembly 78. Packing gland 84 may be adjusted, when needed, in the same manner as for the previous embodiments.

Figure 8:
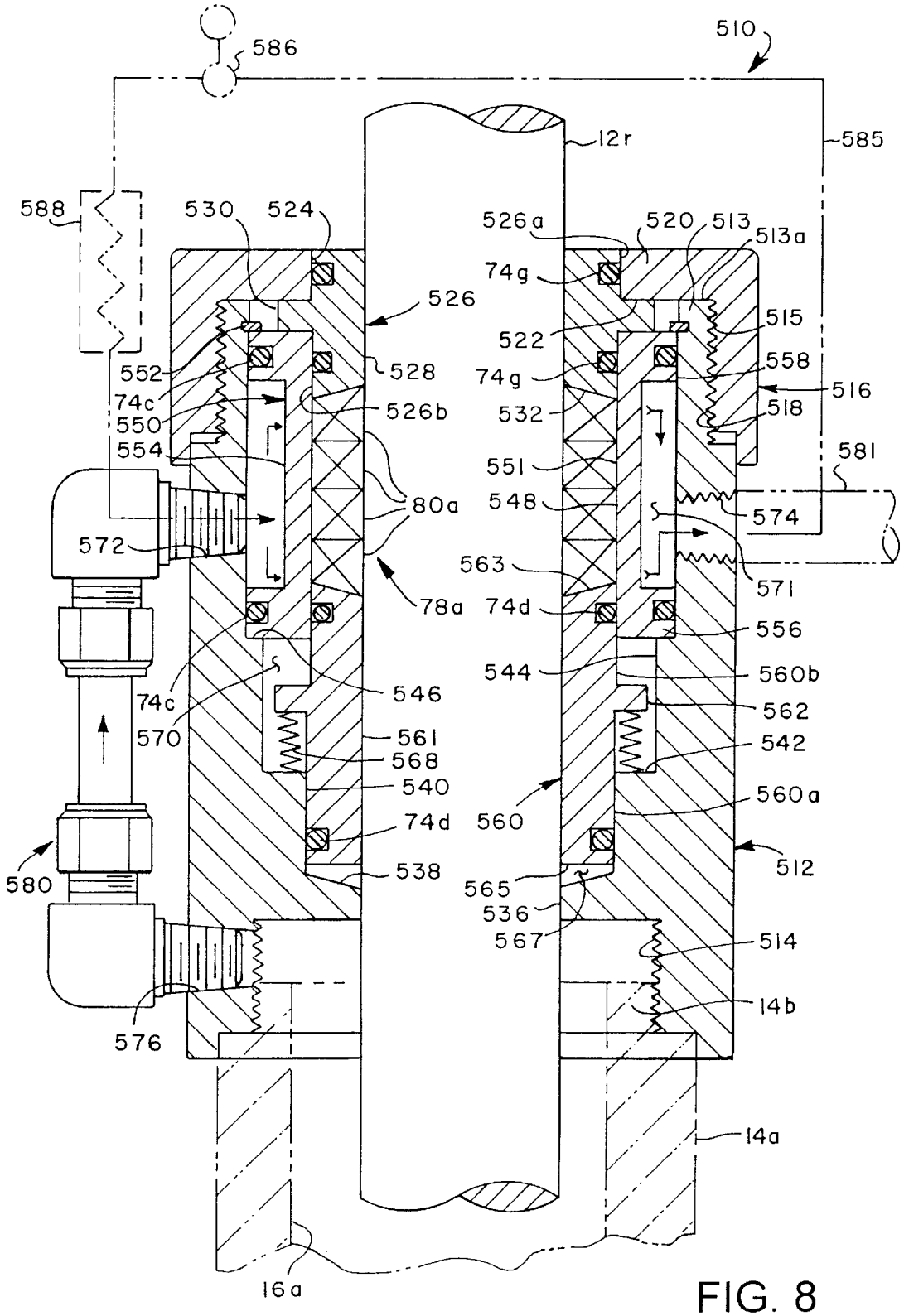
FIG. 8 is a longitudinal central section view of a rotary shaft adjustable stuffing box and seal assembly in accordance with the invention.

Referring now to FIG. 8, there is illustrated a rotary shaft stuffing box and seal assembly 510 which enjoys the advantages of the stuffing boxes 110, 210, 310 and 410. However, the stuffing box 510 is adapted to provide a seal for a rotary shaft or rod 12*r*. The stuffing box 510 is adapted to be mounted on a suitable wellhead adapter part 14*a* having an internal passage 16*a* in communication with produced fluids being produced by a downhole rotary well pump, not shown, and drivenly connected to the rotary shaft or rod 12*r*. The stuffing box 510 includes a generally cylindrical housing 512 having a downwardly facing internally threaded bore 514 for engagement with a cooperating upwardly facing externally threaded part 14*b* of wellhead structure 14*a* in a manner similar to the arrangement described in U.S. Pat. No. 5,803,169.

The housing 512 includes a reduced diameter upper end part 513 having external threads 515 formed thereon for engagement with a cylindrical somewhat cup-shaped cover 516 having cooperating internal threads 518 engaged with threads 515, a transverse topwall portion 520 delimited by a face 522 and a bore 524 for journalling a packing gland 526.

Packing gland 526 includes an internal bore 528 for receiving shaft or rod 12*r* and an annular flange 530 interposed gland portions 526*a* and 526*b*, which are preferably of equal diameter. Packing gland 526 includes a tapered or sloped transverse end face 532 engageable with a packing assembly 78*a* having annular split packing rings 80*a* axially stacked around shaft 12*r*, as shown, and engageable with the shaft to substantially prevent the escape of fluid from passage 16*a* to the exterior of the stuffing box 510. O-ring seals 74*g* g are supported on packing gland 526 for sealing engagement with bore 524 and a bore 551 formed in a packing housing 550.

Housing 512 includes a reduced diameter bore 536 slightly larger in diameter than the diameter of the shaft 12*r* and intersecting a transverse shoulder 538 delimited by a larger bore 540. Bore 540 extends upwardly to a transverse annular shoulder 542 interposed the bore 540 and a yet larger diameter bore 544. A third, substantially transverse annular shoulder 546 is interposed the bore 544 and still a further and larger diameter bore 548 of housing 512 extending upwardly to the upper distal end part 513 and opening to transverse end face 513*a* of housing 512.

Packing housing 550 comprises a generally cylindrical spool shaped member disposed in the bore 548 and is retained therein by a releasable retaining ring 552 suitably disposed in an annular grove in housing 512, as shown. Packing housing 550 includes a hub portion 554 between opposed annular flanges 556 and 558. Flanges 556 and 558 support spaced apart o-ring seals 74*c* in sealing engagement with housing bore 548. Packing housing 550 also includes an internal bore 551 for supporting packing assembly 78*a* between packing gland 526 and an axially slidable packing adjustment bushing 560.

Bushing 560 includes an internal bore 561 slightly larger in diameter than the diameter of shaft 12*r* and a radially projecting circumferential flange 562 interposed equal diameter bushing portions 560*a* and 560*b*. O-ring seals 74*d* are supported in suitable annular grooves on bushing portions 560*a* and 560*b*, as shown in FIG. 8, and are in sealing engagement with the bore walls of bores 540 and 551, respectively. A tapered or sloped end face 563 of bushing 560 is opposed to end face 565 and is engagement with the packing assembly 78*a*. A suitable coil or wave type spring 568 is disposed in an annular cavity 570 formed by the lower housing 512, the packing housing 550 and the bushing 560 and is engageable with the flange 562 to urge the bushing 560 upwardly to compress the packing assembly 78*a* in substantially the same manner as the packing adjustment bushings of the stuffing boxes 10, 110, 210, 310 and 410 operate. Thanks to the equal seal diameters of the bushing portions 560*a* and 560*b* the cavity 570 remains at a neutral pressure and may be filled with a suitable lubricant to lubricate the o-ring seals 74*d* and substantially prevent the migration of corrosive fluids through the stuffing box to the packing assembly 78*a*, in particular. Moreover, pressure fluid entering annular cavity 567 between the transverse face 538 on the housing 512 and the transverse end face 565 of the bushing 560 urges the bushing to compress the packing assembly 78*a* with a force proportional to the fluid pressure in passage 16*a*.

Another important advantage of the stuffing box 510 is the provision of means for cooling the packing assembly 78*a* during operation of the stuffing box 510 due to frictional heat buildup resulting from engagement of the packing assembly 78*a* with the rotating shaft 12*r*. The packing housing 550 forms, together with the lower housing 512, an annular cavity or channel 571 operable to be in communication with opposed ports 572 and 574 in the housing 512. A third port 576 in housing 512 is in communication with the bore 514 and the passage 16*a*. Suitable conduit means 580 interconnect ports 572 and 576 for conducting produced fluids from a well to and through the annular channel 571 in heat exchange relationship with the packing housing 550 to remove heat buildup in packing assembly 78*a*. Fluid conducted through the annular channel 571 exits the stuffing box 510 through suitable conduit means 581 which may be connected to a produced fluids flowline, not shown. Accordingly, produced fluid from a well to which the wellhead structure 14*a* is connected, may be used to cool the stuffing box 510 in a unique manner. Alternatively, the port 576 may be suitably plugged and, as shown in FIG. 8, an alternative cooling circuit may be provided including conduit means 585 in communication with the ports 572 and 574 and having a suitable motor driven pump 586 and a heat exchanger 588 interposed therein for circulating a suitable coolant continuously through the stuffing box 510. Still further, other sources of coolant fluid, not shown, may be connected to the port 572 for circulation through the channel 571 and for removal from the stuffing box through port 574.

The operation of the stuffing box 510 is similar in many respects to the stuffing boxes 10, 110, 210, 310 and 410 in that the slidable bushing 560 responds to the urging of the spring 568 and pressure fluid forces acting on the face 565 to compress the packing assembly 78*a* to provide a substantially fluid tight seal for the rotary shaft 12*r*. The packing assembly may be replaced, when needed, by removing the housing cover 516 and the packing gland 526 and moving these members upward on shaft 12*r* sufficiently to gain access to the packing assembly 78*a*, as needed and then reconnecting the packing gland and the cap 516 to the lower housing 512. The packing housing 550 and the bushing 560 may also be removed from the upper end 513 of the housing 512 without removing the housing from the wellhead structure 14*a*.

The stuffing boxes 10, 110, 210 310, 410 and 510 may be constructed using conventional engineering practices known to those skilled in the art. The stuffing boxes 10, 110, 210, 310, 410 and 510 may also utilize conventional engineering materials, other than as described herein, for the various components described and shown. The spring or springs 47 may be configured other than as wave springs, as indicated. Still further, the assembly, disassembly and adjustment of the stuffing boxes 10, 110, 210, 310, 410 and 510 and the use of the stuffing boxes for other but similar reciprocating or rotating rod sealing applications is believed to be within the purview of one of ordinary skill in the art based on the foregoing description and the features illustrated in the drawing figures.

Although preferred embodiments of the invention have been described in detail hereinabove, those skilled in the art will also recognize that various substitutions or modifications may be made to the invention without departing from the scope and spirit of the appended claims.

What is claimed is:

1. A stuffing box for a cylindrical pump rod comprising:

a first housing adapted to be supported on a structure which includes a passage in which pressure fluids are present and for which a seal is to be formed around said pump rod to prevent pressure fluid from escaping said passage, said first housing including a first bore forming a clearance bore for said pump rod, a second bore larger than said first bore, and a first portion extending between said second bore and a transverse end wall of said first housing;

a packing housing including a second portion engageable with said first portion of said first housing, said packing housing including a central bore formed therein;

a packing assembly disposed in said bore in said packing housing and operable to be in sealing engagement with said pump rod;

a packing gland operably engageable with said packing assembly at substantially one end thereof;

a bushing including a first part slidably disposed in said bore in said packing housing and operably engageable with an opposite end of said packing assembly for compressing said packing assembly, said bushing including an end face exposed to pressure fluid from said passage for urging said bushing to compress said packing assembly, a transverse shoulder and a second part extending from said shoulder in sliding relationship with a bore formed in one of said housings and including said end face exposed to said pressure fluid; and spring means operably engageable with said shoulder for urging said bushing into forcible engagement with said packing assembly to impose compression forces on said packing assembly.

2. The stuffing box set forth in claim 1 including:

a cavity formed at least in part by one of said housings and retaining said spring means therein.

3. The stuffing box set forth in claim 2 wherein:

said first part and said second part of said bushing are of substantially equal diameter, said cavity is adapted to receive a lubricant fluid therein and said cavity remains at a substantially constant pressure in response to movement of said bushing with respect to said cavity to prevent forcible displacement of said lubricant from said cavity.

4. The stuffing box set forth in claim 2 wherein:

said bushing includes a circumferential flange formed thereon and defining said transverse shoulder for engagement with said spring means.

5. The stuffing box set forth in claim 2 wherein:

said packing housing includes a separable part for retaining said bushing in said packing housing, said packing housing and said separable part defining said cavity.

6. The stuffing box set forth in claim 1 wherein:

said packing housing includes a stepped bore for receiving said bushing and defining a cavity between said bushing and said packing housing for retaining said spring means therein and acting on said bushing.

7. The stuffing box set forth in claim 2 wherein:

said second bore in said first housing includes a portion for receiving said bushing in slidable relationship therein and a transverse shoulder in said first housing for supporting said spring means for engagement with said bushing.

8. The stuffing box set forth in claim 1 including:

an annular cavity formed between said packing housing and said first housing and in communication with conduit means for conducting a coolant fluid through said cavity to cool said packing assembly.

9. The stuffing box set forth in claim 8 wherein:

said conduit means is in communication with pressure fluid communicated thereto from said structure on which said first housing is adapted to be supported.

10. The stuffing box set forth in claim 8 wherein:

said conduit means comprises a closed loop conduit connected to an inlet port and an outlet port in said first housing, respectively, and in communication with said annular cavity, and said conduit means includes a pump and a heat exchanger interposed therein for circulating coolant through said annular cavity to cool said packing assembly.

11. The stuffing box set forth in claim 9 including:

a cover member releasably connected to said first housing for retaining said packing gland in operable engagement with said packing assembly.

12. A stuffing box for a cylindrical pump rod comprising:

a first housing adapted to be supported on a structure which includes a passage in which pressure fluids are present and for which a seal is to be formed around said pump rod to prevent pressure fluid from escaping said passage, said first housing including a first bore forming a clearance bore for said pump rod, a second bore larger than said first bore, and a first portion extending between said second bore and a transverse end wall of said first housing;

a packing housing including a second portion engageable with said first portion of said first housing, said packing housing including a central bore formed therein;

a packing assembly disposed in said bore in said packing housing and operable to be in sealing engagement with said pump rod;

a packing gland operably engageable with said packing assembly at substantially one end thereof;

a bushing including a first part slidably disposed in said bore in said packing housing and operably engageable with an opposite end of said packing assembly for compressing said packing assembly; and a removable spacer ring disposed between said housings for maintaining said housings in a predetermined positional relationship relative to each other.

13. The stuffing box set forth in claim 12 including:

an annular packoff element disposed in said first housing engageable with said packing housing to be deflected into sealing engagement with said rod in response to movement of said packing housing relative to said first housing.

14. The stuffing box set forth in claim 13 wherein:

said first portion of said first housing and said second portion of said packing housing include cooperating threads thereon, respectively, for securing said housings to each other and providing for rotation of said packing housing relative to said first housing to deflect said packoff element into sealing engagement with said pump rod.

15. The stuffing box set forth in claim 14 wherein:

said packing housing includes an upper flange part engageable with said ring and said first housing includes a transverse endwall engageable with said ring for limiting the extent of threaded engagement of said packing housing with said first housing.

16. The stuffing box set forth in claim 14 including: at least one wrench receiving bore formed in said packing housing for receiving wrench means for rotating said packing housing relative to said first housing.

17. A stuffing box for a reciprocating cylindrical pump rod comprising:

a first housing adapted to be supported on a structure which includes a passage in which pressure fluids are present and for which a seal is to be formed around said pump rod to prevent pressure fluid from escaping said passage, said first housing including a first bore formed therein and an internally threaded portion extending between said first bore and a transverse end wall of said first housing;

a packing housing including an externally threaded portion threadedly engageable with said internally threaded portion of said first housing, said packing housing including a central bore formed therein;

a packing assembly operable to be disposed in said bore in said packing housing and in sealing engagement with said rod;

a packing gland extending within said bore in said packing housing and operably engageable with said packing assembly at substantially one end thereof;

a flange connected to said packing gland and releasably connected to said packing housing by fastener means for adjusting a compression force on said packing assembly;

a bushing including a first part slidably disposed in said bore in said packing housing and operably engageable with the opposite end of said packing assembly for compressing said packing assembly to seal said rod against pressure fluid from said passage; and means for urging said bushing into forcible engagement with said packing assembly to compress said packing assembly into engagement with said rod.

18. The stuffing box set forth in claim 17 wherein:

said bushing includes an end face exposed to pressure fluid from said passage for urging said bushing to forcibly compress said packing assembly.

19. The stuffing box set forth in claim 17 including:

spring means operably engageable with said bushing for urging said bushing to compress said packing assembly.

20. The stuffing box set forth in claim 19 wherein:

said packing housing includes a stepped bore for receiving said bushing and defining a cavity between said bushing and said packing housing for retaining said spring means therein and acting on said bushing.

21. The stuffing box set forth in claim 19 wherein:

said bushing includes a flange formed thereon for engagement with said spring means.

22. The stuffing box set forth in claim 21 wherein:

said packing housing includes a separable part for retaining said bushing in said packing housing, said packing housing and said separable part defining a cavity for retaining a lubricant therein, said cavity being operable to maintain a constant pressure therein in response to movement of said bushing therein.

23. The stuffing box set forth in claim 21 wherein:

said bushing includes opposed cylindrical parts of substantially the same diameter and slidably disposed in cooperating bores in said packing housing and in one of said first housing and said packing housing.

24. The stuffing box set forth in claim 23 wherein:

said bushing includes a reduced diameter part having a diameter less than said opposed cylindrical parts, said reduced diameter part including an end face engageable with said packing assembly.

25. The stuffing box set forth in claim 17 including:

a removable spacer ring interposed between said housings for maintaining said housings in a predetermined relationship of said threaded portions relative to each other and an annular packoff element disposed in said first housing, and engageable with said packing housing and adapted to be deflected into sealing engagement with said rod in response to movement of said packing housing relative to said first housing.

26. A stuffing box for a cylindrical pump rod comprising:

a first housing adapted to be supported on a structure which includes a passage in which pressure fluids are present and for which a seal is to be formed around said pump rod to prevent pressure fluid from escaping said passage;

a packing housing cooperable with said first housing and including a central bore formed therein;

a packing disposed in said bore in said packing housing and operable to be in sealing engagement with said pump rod;

a packing gland engageable with said packing;

a bushing axially slidably disposed in said first housing including an annular flange formed thereon, a first cylindrical part having a diameter less than said flange extending from said flange and slidably disposed in a bore formed in one of said housings in substantially fluid sealing engagement therewith, said first part including a transverse end face responsive to pressure fluid forces acting thereon to urge said bushing into forcible engagement with said packing and a second cylindrical part extending from said flange opposite said first part and into said bore in said packing housing and engaged with said packing;

spring means engaged with said flange on said bushing for urging said bushing into forcible engagement with said packing and for moving said bushing within said first housing as said packing wears to maintain said forcible engagement; and said packing gland is adjustable with respect to said first housing to reposition said bushing within said first housing after a predetermined amount of travel of said bushing to maintain said forcible engagement with said packing as said packing wears.

27. The stuffing box set forth in claim 26 including:

an annular cavity formed in said stuffing box and partially defined by said bushing for containing a lubricant fluid therein to lubricate at least one seal disposed on said bushing.

28. A stuffing box for a cylindrical rotatable pump rod comprising:

a first housing adapted to be supported on a structure which includes a passage in which pressure fluids are present and for which a seal is to be formed around said pump rod to prevent pressure fluid from escaping said passage, said first housing including a portion for receiving a packing housing therein;

a packing housing disposed in said first housing and including a central bore formed therein;

a packing assembly disposed in said bore in said packing housing and operable to be in sealing engagement with said pump rod;

a bushing slidably disposed in said first housing and including a first cylindrical part slidably disposed in said bore in said packing housing and engageable with said packing assembly for exerting compression forces on said packing assembly, a second cylindrical part slidably disposed in a bore in said first housing and an annular flange disposed between said first and second parts of said bushing; and a spring engaged with said flange for urging said bushing into forcible engagement with said packing assembly, and said spring and said bushing are disposed in a cavity in said stuffing box for receiving a lubricant for said bushing.

29. The stuffing box set forth in claim 28 wherein:

said bushing includes a transverse face formed thereon and operable to be exposed to said pressure fluids for exerting a pressure force on said bushing to move said bushing into forcible engagement with said packing assembly.

30. The stuffing box set forth in claim 28 including:

an annular cavity formed between said packing housing and said first housing and in communication with conduit means for conducting a coolant fluid through said cavity to cool said packing assembly.

31. The stuffing box set forth in claim 30 wherein:

said conduit means is in communication with pressure fluid communicated thereto from said structure on which said first housing is adapted to be supported.

32. The stuffing box set forth in claim 30 wherein:

said conduit means comprises a closed loop conduit connected to an inlet port and an outlet port in said first housing, respectively, and in communication with said annular cavity, and said conduit means includes a pump and a heat exchanger interposed therein for circulating coolant through said annular cavity to cool said packing assembly.

33. The stuffing box set forth in claim 28 including:

a cover member releasably connected to said first housing for retaining said packing gland in operable engagement with said packing assembly.

34. A stuffing box for a cylindrical pump rod comprising:

a first housing adapted to be supported on a structure which includes a passage in which pressure fluids are present and for which a seal is to be formed around said pump rod to prevent pressure fluid from escaping said passage, said first housing including a first bore forming a clearance bore for said pump rod, a second bore larger than said first bore, and a first portion extending between said second bore and a transverse end wall of said first housing;

a packing housing including a second portion engageable with said first portion of said first housing, said packing housing including a central bore formed therein;

a packing assembly disposed in said bore in said packing housing and operable to be in sealing engagement with said pump rod;

a packing gland operably engageable with said packing assembly at substantially one end thereof;

a bushing including a first part slidably disposed in said bore in said packing housing and operably engageable with an opposite end of said packing assembly for compressing said packing assembly;

a transverse flange part connected to said packing gland; and circumferentially spaced apart fastener means engageable with said flange part and said packing housing for retaining said packing gland connected to said packing housing, said packing gland and said flange part being rotatably indexable with respect to said packing housing at predetermined positions for rotatably positioning said packing gland to distribute lateral wear thereon.

* * * * *